United States Patent [19]

Conville

[11] Patent Number: 5,056,796

[45] **Date of Patent: * Oct. 15, 1991**

[54] SELF CONTAINED BAG TOSSING GAME

[75] Inventor: David J. Conville, Hot Springs, Ark.

[73] Assignees: Conlab, Inc., Hot Springs; Nancy E. Carver, Roland, both of Ark.

[ * ] Notice: The portion of the term of this patent subsequent to Oct. 9, 2007 has been disclaimed.

[21] Appl. No.: 592,813

[22] Filed: Oct. 4, 1990

Related U.S. Application Data

[63] Continuation-in-part of Ser. No. 479,976, Feb. 14, 1990, Pat. No. 4,961,586.

[51] Int. Cl.[5] ..... A63B 63/00; A63B 67/00

[52] U.S. Cl. ..... 273/402

[58] Field of Search ..... 273/401, 402, 415, 398, 273/400

[56] References Cited

U.S. PATENT DOCUMENTS

| | | | |
|---|---|---|---|
| D. 252,047 | 6/1979 | Cirrone | D21/1 |
| 285,396 | 9/1983 | DeWindt | 273/402 X |
| 922,717 | 5/1990 | Parker | 273/401 |
| 2,021,989 | 11/1935 | DeMaster | 273/401 |
| 2,291,104 | 7/1942 | Radzyner | 434/261 |
| 3,480,280 | 11/1969 | Gamertsfelder | 273/415 |
| 3,554,550 | 1/1971 | Schram | 273/392 X |
| 3,628,793 | 12/1971 | Mudloff | 273/402 |
| 3,837,650 | 9/1974 | Haney | 273/402 |
| 3,837,653 | 9/1974 | Fox et al. | 273/178 R |
| 4,116,443 | 9/1978 | Dorfman | 273/388 |
| 4,186,925 | 2/1980 | Goldfarb et al. | 273/389 |
| 4,243,229 | 1/1981 | Huser et al. | 273/402 |
| 4,565,375 | 1/1986 | Dresel | 273/401 |
| 4,709,929 | 12/1987 | Mills | 273/402 |
| 4,961,586 | 10/1990 | Conville | 273/402 |

*Primary Examiner*—William H. Grieb

*Attorney, Agent, or Firm*—Stephen D. Carver

[57] ABSTRACT

A blow molded, plastic, bag tossing game for use by one or more players can be disposed in either a transportable mode, a display mode, or a playing mode. In the playing mode a pair of identical, modular target assemblies are deployed in spaced apart relationship to present a pair of slightly inclined, apertured targets towards which soft bags are thrown to generate points in accordance with rules. Each target assembly comprises a resilient, generally rectangular plastic playing board which includes a target aperture. Each target board is inclined for play by two elevator trays which are pivotally coupled to each board. For storage each elevator tray can be folded into position on the underside of the target board. The bags are captivated during storage within sunken orifices defined in the boards. The orifices define reinforcement means, which brace the apparatus and obivate separate right angled struts. Pins projecting from each board penetrate suitable orifices defined on the opposite board to facilitate snap fitting. The boards may be fitted together to maintain a sleek, overall low profile. Handles project from recessed notches defined in each playing board. A recessed external surface defined in said playing board for receiving an apertured insert for displaying an advertisement. The larger elevator tray comprises a recessed circle for registering with the target aperture when the game is disposed in the transportable position for displaying the remainder of the advertisement. Hook means are provided for non-destructively reversibly flush mounting the game.

20 Claims, 4 Drawing Sheets

SELF CONTAINED BAG TOSSING GAME

CROSS REFERENCE TO RELATED APPLICATION

This application is a continuation-in-part of the copending application Ser. No. 07/479,976, filed: Feb. 14, 1990, entitled Bag Tossing Game which matured to issue on Oct. 9, 1990 as U.S. Pat. No. 4,961,586.

BACKGROUND OF THE INVENTION

My invention relates generally to bag tossing games involving one or more players. More particularly, the invention relates to bag tossing games involving apertured, slightly inclined targets which can be coupled together for transportation, and which can also function as display devices for advertising logos and the like.

In the prior art a variety of tossing games including a number of different projectiles and missiles have been proposed. Previous tossing games have employed metallic darts, golf balls, softballs, baseballs, footballs and the like. The prior art also reflects generally inclined, target board devices having an apertured front surface which act as targets for associated projectiles.

The concept of providing a tossing game with apertured, inclined planes which function as targets was disclosed in U.S. Pat. No. 2,021,989, issued Nov. 26, 1935. The latter reference discloses an inclined plane having an aperture functioning as a target. When balls are tossed by a player towards the target, they may be collected within a captivated collection pocket if they penetrate the target orifice.

The most relevant prior art known to me comprises U.S. Pat. No. 3,628,793, issued Dec. 21, 1971, and entitled Sandbag and Target Apparatus. In that device a pair of fixed, wedge shaped half sections, each including an apertured and inclined plane functioning as a target, may be deployed separately in a tossing game configuration, or they may be clamped together when desired to transport the device. Preferably bags are tossed towards the each target, and various points may be scored by the players. Scoring, for example, may take place when bags penetrate the central orifice, or remain on the target surface after a round. Both of the target half sections are relatively cumbersome and heavy, making convenient transportation and deployment difficult. In addition, when the two target wedges are clamped together, the net volume of the coupled unit is approximately twice that of either wedge unit alone.

U.S. Pat. No. 4,709,929 issued Dec. 1, 1987 discloses a pair of apertured game boards which can be deployed in an inclined playing mode, and which can be coupled together for transportation. Haney U.S. Pat. No. 3,837,650, issued Sept. 24, 1974 discloses a bag tossing target device having a pair of hingedly connected panels which can be deployed in an inclined plane target mode. An aperture in the target surface is provided for receiving a bag, and the game contemplates scoring by penetrating the orifice. Similar devices are seen in U.S. Pat. No. 2,291,104, issued July 28, 1942, U.S. Pat. No. 4,223,229 issued Jan. 6, 1981, and U.S. Pat. No. 4,565,375, issued Jan. 21, 1986, all of which disclose target boards having an orifice. U.S. Pat. No. 3,837,653 issued to Fox, Sept. 24, 1974, comprises a game in which a slightly inclined plane forms a target for a golf ball.

Other less relevant tossing games involving bags or the like can be seen in U.S. Pat. Nos. 3,554,550; 4,186,925; 4,116,443; and U.S. Pat. Des. No. 252,047. U.S. Pat. No. 3,480,280, issued Nov. 25, 1969 discloses a bean bag design for a projectile suitable for use in bag tossing games.

However, the known prior art fails to disclose a bag tossing game in which identical, lightweight board components may be easily snapped together for suitable transportation, and which may be quickly unsnapped and then foldably erected for play. The devices proposed heretofore have not disclosed a game wherein the individual interfitting plastic parts enable the game to be quickly deployed in either transportable, display, or playing modes, wherein the parts are appropriately reinforced without adding unnecessary weight. None combines a bag storage device in a modularized embodiment in which weight has been evenly distributed for ease of handling, and no known prior art bag tossing game design economically facilitates production through blow molding techniques. No known bag tossing game combines an advertisement which is integral with the game but yet separate.

SUMMARY OF THE INVENTION

My invention comprises a tossing game for use by one or more players which can be conveniently disposed in either a low profile transportable position, which also functions as a display position, or a playing position in which a pair of identical modular target assemblies are first separated from one another and then unfolded and deployed in a playing position.

Each target assembly is of similar configuration, preferably comprising a resilient, blow molded plastic playing board assembly of generally rectangular configuration. A plurality of projectiles, preferably harmless popcorn-filled bags, are packaged between the assemblies. Each assembly comprises a target aperture towards which the bags are aimed and thrown by competing players. Means are provided for quickly switching the game apparatus between desired orientations.

For example, the playing boards can be coupled together for storage or transportation in a flat, low profile configuration not unlike a small suitcase. Handles associated with each playing board can be used to conveniently carry the apparatus. The individual target modules can then be separated for erection in a playing mode in which both assume an inclined, generally triangular orientation.

Each target board preferably comprises a periphery from which outwardly projecting pins emanate, and cooperating spaced apart apertures for receiving the pins from the companion board. When the boards are coupled together, a low profile results, and the game is generally in the form of a parallelipiped. It is low in profile, since its net thickness in the storage or transportation mode is less than the maximum height of the target board when deployed in the playing mode.

Each target board comprises an elevator system pivotally associated with its ends. The elevator system comprises a pair of generally rectangular elevator trays which, in the playing mode, are unfolded to elevate both board ends. The deployed elevator trays are yieldably maintained in the vertically erect orientation by a detent means associated with each playing board's inner surface. Each elevator tray can be firmly pivoted to a horizontal position adjacent to and generally parallel with underside of the playing board for storage. With the elevator trays so disposed, the playing boards may be frictionally fitted together into the transportable mode while maintaining a sleek, low profile.

For playing, each target assembly is deployed in spaced apart relation upon a suitable surface such as a lawn, floor, or deck. Each deployed assembly presents suitable inclined planes towards which a plurality of bean bags can be thrown. Each target assembly comprises a recessed, target surface adapted to receive an advertising insert. Suitable advertising or display indicia on the insert may be thus displayed upon the target surface. Each playing board is properly inclined by the elevator trays, which are disposed at each end of the board.

The playing board has been uniquely reinforced to make it resistant to impacts. However, no separate reinforcement struts have been included in the design. Instead, reinforcement means are defined between a plurality of bag receptive orifices which are defined within the surface. Those regions between the sunken orifices function as reinforcement ribs, but are integral with the board structure Additional reinforcement is accomplished by providing the recess on the external target surface. Further when the boards are turned upside down, the recess prevents scratching or marring of the advertisement insert. The larger elevator tray comprises a recessed circle for registering with the target aperture when the game is disposed in the transportable position for displaying the remainder of the advertisement. Hook means are provided for non-destructively reversibly flush mounting the game.

Thus a primary object of the present invention is to provide a safe and convenient modular tossing game suitable for enjoyable use by adults and children.

A fundamental object of the present invention is to provide a tossing game of the character described which cannot injure anyone.

Another primary object of the present invention is to avoid the inclusion of separate, elongated reinforcement ribs oriented at right angles to one another in the structure of the board.

A fundamental object is to provide a safe, user-friendly tossing game which is easy to learn and competitive.

A similar object is to provide a tossing game designed to challenge and refine the skills of all players, including experts, novices, women, or children.

Another object is to provide a lightweight game of the character described which may be quickly and easily switched between transportable and playing orientations.

Another object is to provide a board game of the character described which will not move significantly when the board is impacted by projectiles.

Another object is to provide an ultra-lightweight game of the character described which may be quickly and easily switched between transportable and playing orientations.

Still another object is to provide a game of the character described which, in each of its many modes, provides an attractive, user-perceptible display upon which advertising indicia, product logos, or the like may be advantageously deployed.

A still further object of the present invention is to provide a blow molded game of the character described which is adapted to receive a preformed, washable plastic insert suitable for the display of commercial advertising.

Another important object of the present invention is to provide a bag tossing game of the character described which can assume a low profile for ease of storage and transportation.

Another object of the present invention is to provide a modularized tossing game of the character described equipped with pairs of identical, cooperating playing board assemblies to minimize required tooling. It is a feature of the present game that virtually identical, inter-fitting target assemblies can be snap fitted together for low profile transportation.

Yet another object of the present invention is to provide a game of the character described comprising parts adapted to be firmly nested together during transportation to prevent rattling or other unwanted or suspicious noises.

Another object is to provide a commercially practical game of the character described which can replace the admittedly popular, but unfortunately dangerous dart tossing games.

Another object of the present invention is to provide a bag toss game of the character described which is ideal for the display advertisement for unrelated goods and services. It is a feature of the invention that appropriate advertising logos can be prominently displayed in such a manner as to be plainly visible when the game is stored, transported, or played.

Yet another fundamental object of the present invention is to provide a bag toss game of the character described in which both inclined plane targets are modularized and compartmentalized so that they can be folded together into one unitary carrying piece, with the bags and other parts firmly secured therewithin.

Another object is to provide a toss type game using a maximum of subtleties designed to continuously challenge the most seasoned player For example, subtle features of the invention comprise unique target aperture placement and board slope, and material friction coefficients.

An additional object is to provide a game of the character described in which initial, potentially scoring shots can be canceled or nullified by succeeding shots. Because of board material thickness or density, shots initially likely to register scoring points are likely to be canceled or rejected during the subsequent play of successive bags.

Another object is to provide a completely safe tossing game using soft, harmless bags filled with nontoxic materials.

Another object is to provide a design for a bag tossing game of the character described which is capable of maintaining structural integrity, without the necessity of extra reinforcement ribs and the like, and which may be blow molded.

Another object of the present invention is to provide a blow-molded, two piece game apparatus of the character described in which individual elements, such as elevator trays, are hollow so as to be able to optionally receive ballast (i.e. sand).

Another object is to provide a plurality of geometrically spaced apart and dynamically located bag receptive orifices so as to maintain proper weight distribution when the apparatus is disposed in a non-playing, carrying transportation mode.

Another object of the present invention is to provide a means wherein a poster or advertisement may be associated with a blow molded, polyethylene product, which olefin base product generally does not want to "take" adhesives or inks. It is a feature of the present invention that a polystyrene insert is received within a suitable recess defined in the polyethylene blow molded board so as to in turn receive the advertising or display indicia.

Another object is to provide a detent means within a blow molded board of the character described for yieldably maintaining the elevator trays within a desired deployed position.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
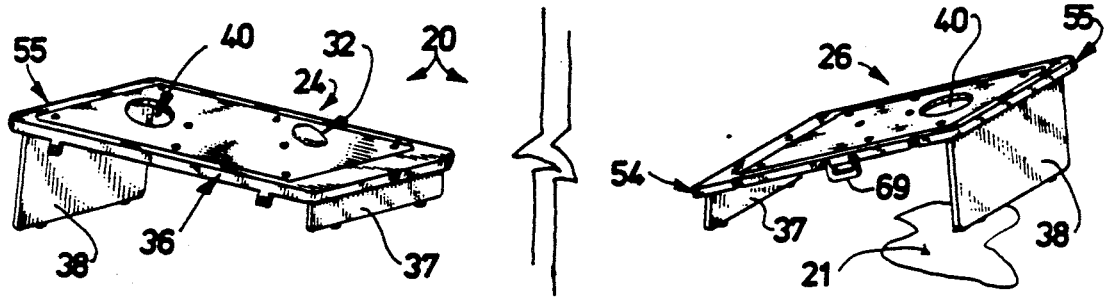
FIG. 1 is a fragmentary perspective view showing my game disposed in the playing mode.
Figure 2:
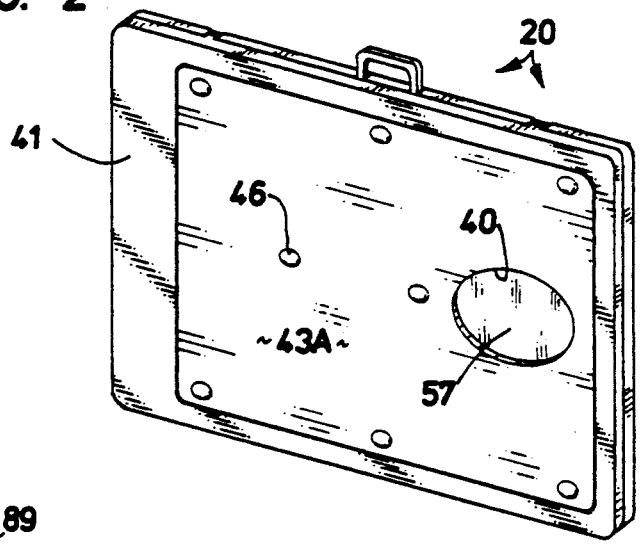
FIG. 2 is a perspective view of the game disposed in its transportable mode.
Figure 3:
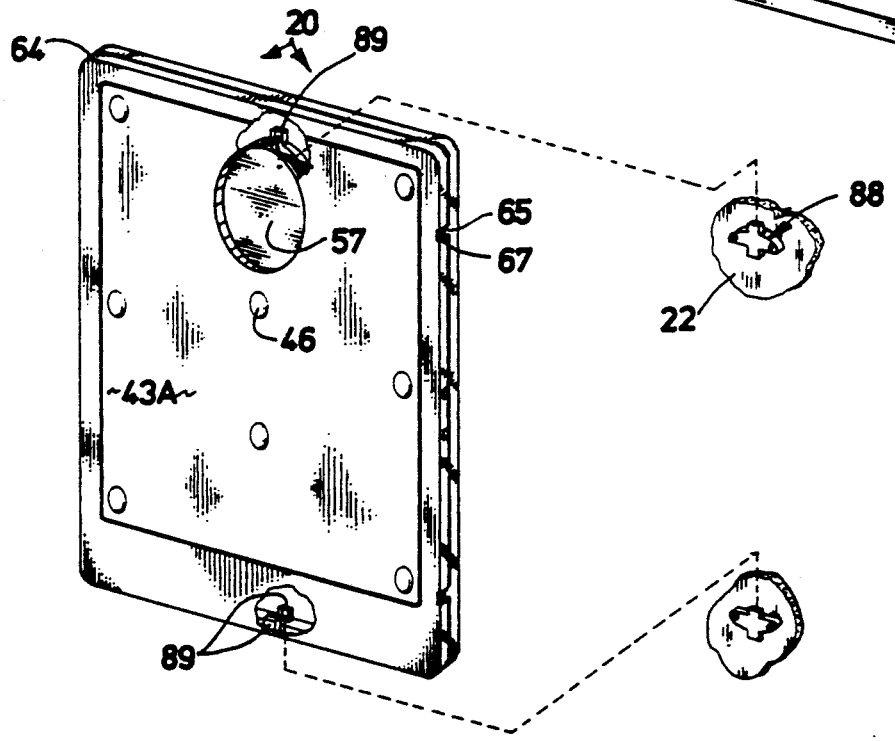
FIG. 3 is an exploded perspective view showing the game disposed in the display and storage mode.

With initial reference directed to FIGS. 1-3 of the appended drawings, my portable tossing game has been generally designated by the reference numeral 20. FIG. 1 illustrates my game deployed in the "playing mode," in which the game modules are separated and spaced apart from one another upon a playing surface 21. FIG. 2 illustrates the game disposed in a "transportable" mode in which the game modules have been folded together and arouse a "suitcase-like" disposition. FIG. 3 illustrates the game disposed in an upright "display" mode temporarily secured upon a wall 22. In the display mode the game is mechanically configured the same as the transportable mode, but it is oriented generally vertically instead of horizontally, and it is typically disposed upon a wall or other flat, vertical structure.

Game 20 comprises a pair of identical target assemblies 24, 26 are first placed upon the ground 21 in spaced relation approximately ten or more adult paces apart. One or more players may then toss suitable projectiles, preferably bean bags 32, towards the inclined target assembles 24, 26. Scoring occurs when the bags appropriately land on the boards 36 and/or penetrate the target aperture 40. The bags are waterproof and preferably filled with corn, and they weigh approximately eight ounces. They are light enough to avoid injury, but heavy enough to be relatively unaffected by modest cross winds during play. It is preferred that the bags be made from vinyl, and that they be ultrasonically sealed for waterproofing. Points are awarded to players or teams of players in accordance with rules discussed hereinafter, when bags either penetrate the target aperture 40, or otherwise remain on the inclined board surface after a round.

Figure 4:
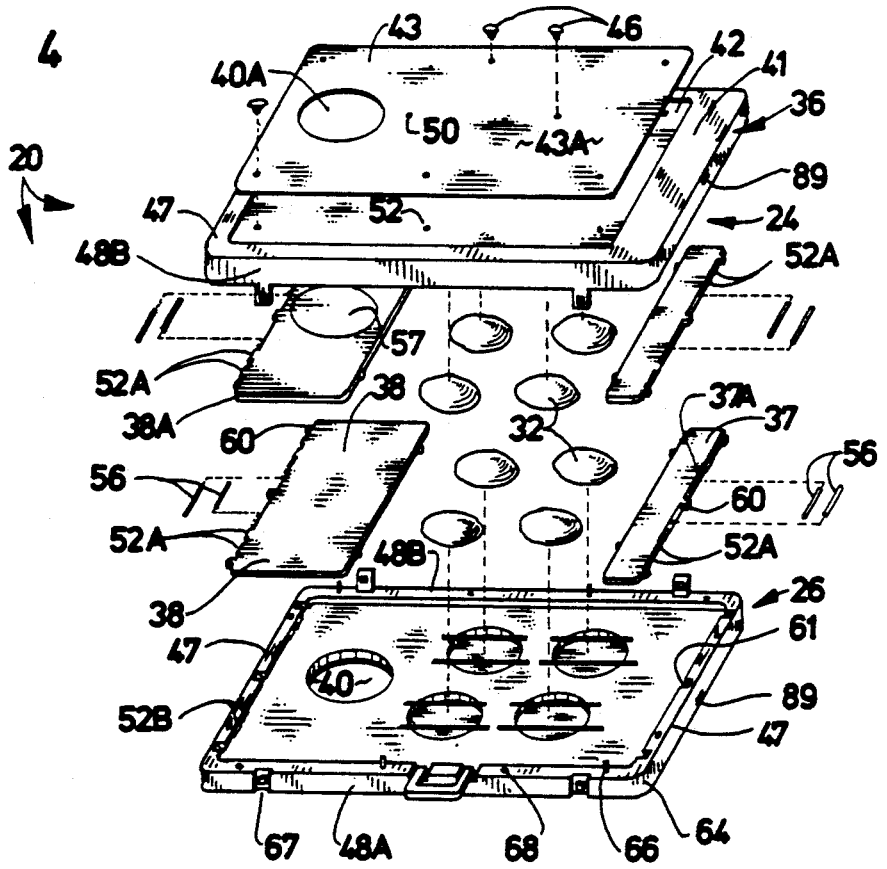
FIG. 4 is an fragmentary, exploded isometric assembly view of the game.
Figure 5:
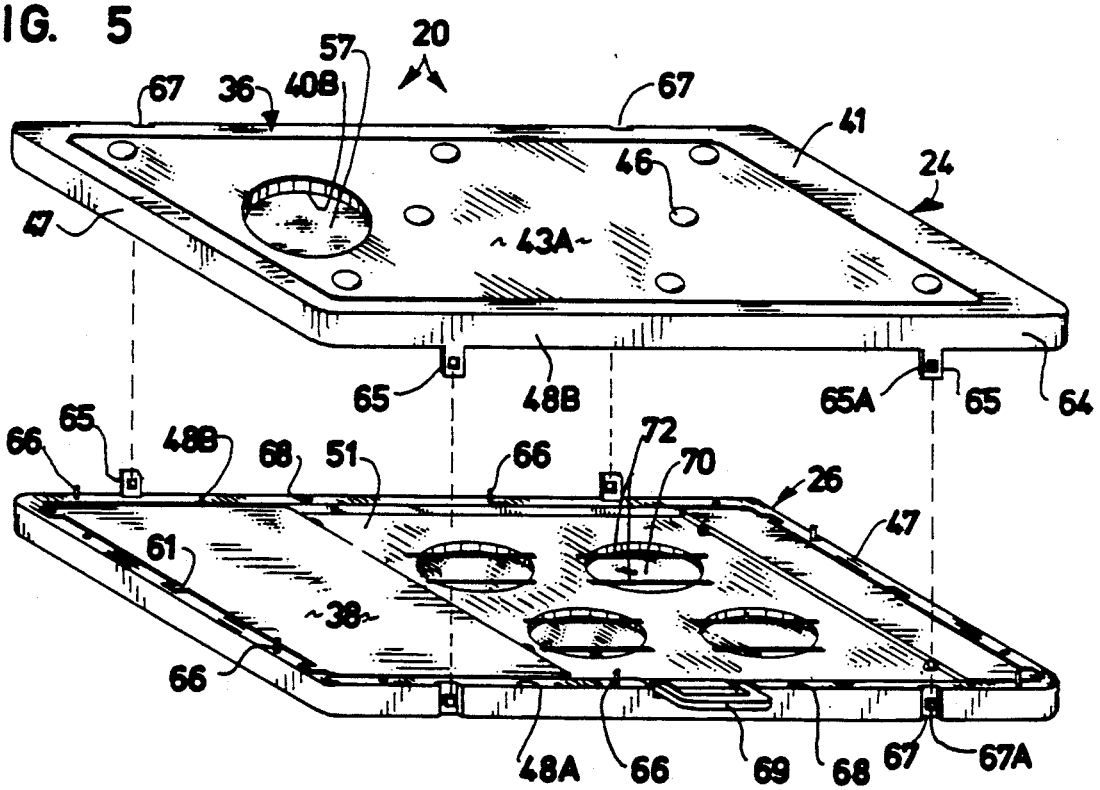
FIG. 5 is an enlarged, isometric similar to FIG. 4, but showing the target assemblies in their generally planar orientation immediately prior to being coupling together for game transportation or storage.

With additional reference directed to FIGS. 4 and 5, the target assemblies 24, 26 are structurally identical. Since the target assemblies 24 and 26 are identical, the components of each individual target assembly will be assigned a single reference numeral, and different portions thereof will be referred to interchangeably in the various views and accompanying discussion. Each comprises a generally rectangular playing board 36 and an associated elevator system which can be deployed to orient and maintain the playing board in an inclined position. The elevator system preferably comprises a pair of elevator trays 37 and 38 which are pivotally coupled to the playing board. Aperture 40 is defined through the playing board and it forms an aiming point for bean bags 32.

The outer face 41 of the playing board includes a recessed inner surface 42 which receives a rectangular insert 43. The insert 43 displays a company logo, product illustration or the like, and it is made of polystyrene, which accepts adhesives and ultraviolet irk (for display purposes) and has a higher coefficient of friction than polyethylene. Insert aperture 40A registers with board aperture 40B (FIG. 5) to form aperture 40. Of course a portion of the rectangular advertisement or display affixed to the insert will be "missing" because of orifice 40A. The circular remainder of the insert/display is attached to a recessed circle 57 defined in the underside of elevator tray 38. When the tray is folded into the transportable position, circle 57 registers with aperture 40 and the insert remainder blends in with the composite display, and the advertisement appears whole to the viewer.

As will be explained hereinafter, the identical target assemblies 24 and 26 may be coupled together to quickly dispose the game 20 in the transportable or display modes.

Each playing board 36 is generally rectangular, and is preferably blow molded from high density polyethylene. The recessed interior surface 51 comprises the underside of the playing board. Surfaces 41 and 51 are integral with peripheral side walls 48A, 48B and end walls 47. Insert 43 comprises a plurality of orifices 50 (FIG. 4) which register in assembly with orifices 53 defined in recessed board surface 42. Suitable plastic fasteners 46 known as "Christmas tree" fasteners secure insert 43 to the board. The external surface 43A of the insert 43 functions as a target surface towards which bags or projectiles 32 are thrown during playing. Preferably the width to length ratio of each surface 41 and/or 51 is approximately two to three.

Figure 7:
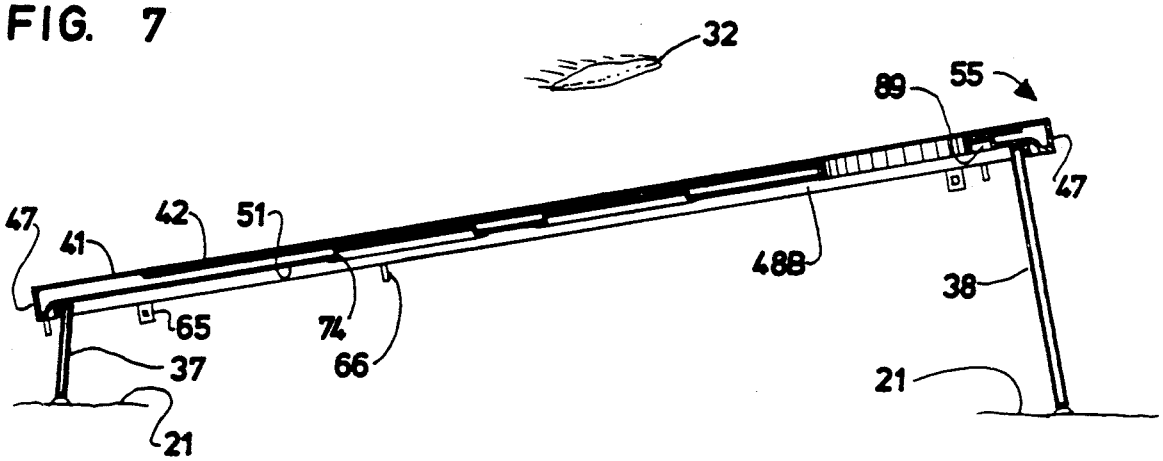
FIG. 7 is a longitudinal sectional view taken generally along line 7—7 of FIG. 6, but with the image inverted to show the board assembly in a playing mode.

Neither board end will be in direct contact with ground 21 during play, since both ends are raised by the elevator system. Elevator tray 37 lifts the lower board end 54, and elevator tray 38 lifts the higher end 55 (FIGS. 1, 7). Elevated end 55 shall also be referred to as the apertured end, for it is preferred to dispose the aperture 40 relatively high up as in FIG. 1. Preferably the diameter of aperture 40 is one-fourth the width of the board. Approximately eighty percent of the length of the board is disposed beneath the center of aperture 40.

Figure 9:
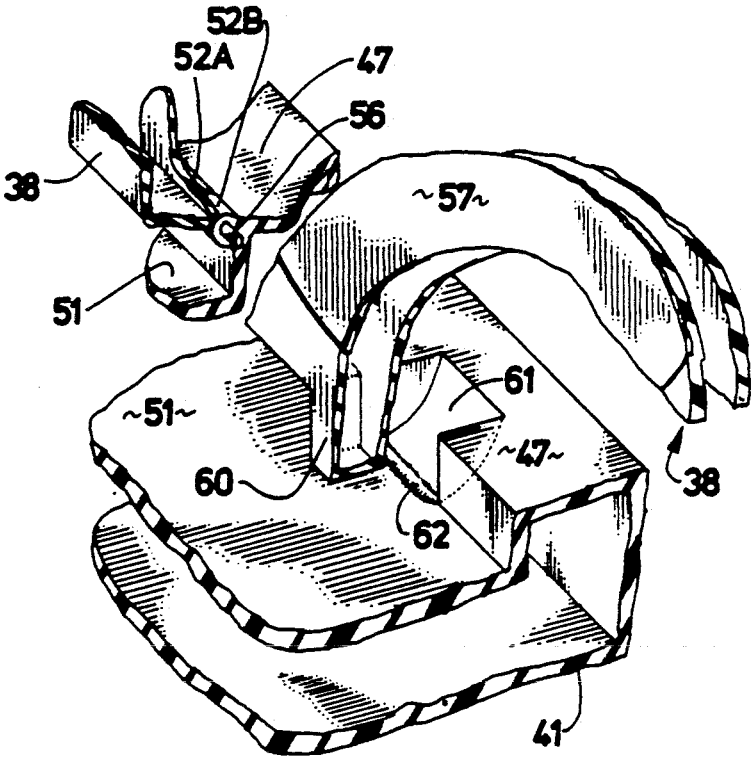

As seen in FIG. 4, the inner ends 37A and 38A of each elevator tray includes suitable mandrels 52A which are pivotally secured to board mandrels 52B by axles 56. Each elevator tray 37, 38 is thus pivoted to the playing board ends. Each can be nested within the recessed underside 51 of the playing board when the game is to be disposed in either the transportable or the display position. When the larger tray 38 is so nested, it will block the target aperture 40 (FIGS. 2, 3 5). Both trays can be pivoted and snapped into position to dispose the playing board in an inclined, generally right triangular playing orientation. For this purpose each tray includes a plurality of spaced apart, outwardly projecting follower tabs 60 (i.e. FIGS. 4, 9). These tabs are integral with and spaced apart from mandrels 52A. When the elevator trays are folded to the storage position, tabs 60 ride within guide slots 61 defined in the ends 47 of the boards, adjacent the recessed inner surface 51. When the elevator trays are snapped to the perpendicular position, tabs 60 yieldably maintain the trays straight when they traverse detents 62 (FIG. 9) bordering guide slots 61. Suction cups 39 are provided at the bottom of the elevator trays for playing stability.

In the transportation or display modes the elevator trays are folded into the board undersides. In the display mode shown in FIG. 3, the game 20 may be flatly disposed upon a suitable surface such as wall 22 in a generally vertical orientation, being retained by a pair of identical, vertically spaced apart hooks 88 secured to wall 22. The game will be non-destructively and reversibly flush mounted upon wall 22. The hooks 88 engage recesses 89 (FIGS. 3, 7) defined in the aperture 40 and at the bottom of the board. When different advertisements are displayed upon the inserts for opposite recessed surfaces of the game, the display can be quickly reversed simply by lifting the game from the hooks, rotating it 180 degrees, and then reattaching the game to the hooks.

The generally rectangular recessed inner surface 51 is bounded by a the surrounding peripheral wall comprising sides 48A and 48B and ends 47. The wall segments arcuately meet in gradually rounded corners 64. The height of the peripheral wall essentially corresponds to the thickness of a single playing board. When the playing boards are coupled together as shown in FIGS. 2–5, the net thickness of the apparatus is thus approximately twice that of an individual module, or of the wall height.

As best viewed in FIGS. 4 and 5, the peripheral wall locates a plurality of pins 66 projecting upwardly which seat within suitable orifices 68 defined in the wall. Symmetry is appropriate so the pins of one board meet the orifices in the corresponding opposite wall of the companion board. Wall 48B also comprise integral, downwardly projecting prongs 65 adapted to be snap fitted within receptive notches 67 formed in the peripheral wall section 48A. In assembly, prong orifices 65A receive notch nubs 67A. Thus in the transportable mode (FIG. 2) or the display mode (FIG. 3) unit integrity is preserved. A convenient carrying handle 69 also projects out of each wall segment 48A.

Figure 6:
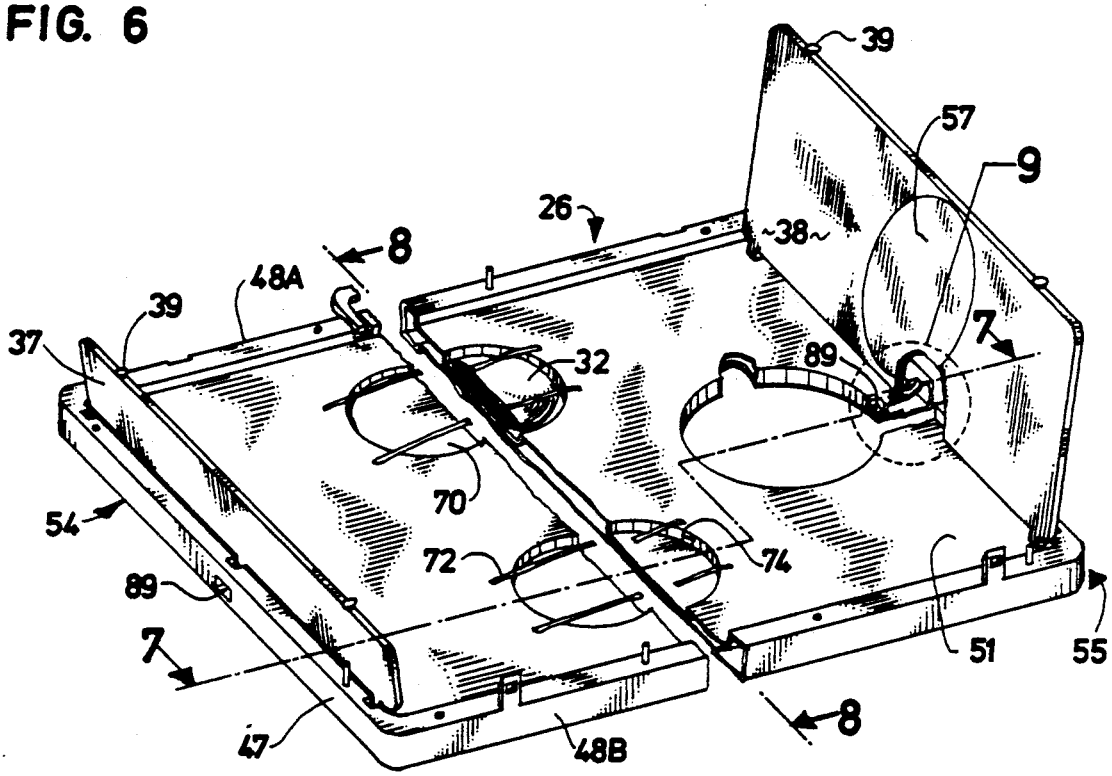
FIG. 6 is a fragmentary isometric view showing the underside of an inclined, playing board assembly, with portions thereof broken away or shown in section for clarity, or omitted for brevity.
Figure 8:
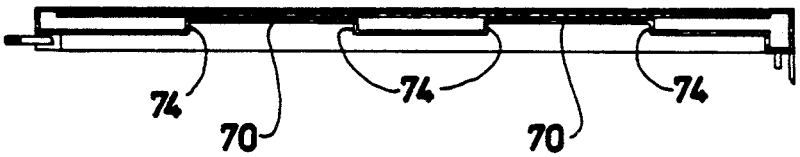
FIG. 8 is a transverse fragmentary sectional view taken generally along line 8—8 of FIG. 6 in the direction of the arrows, but with the image inverted to show the playing mode; and, FIG. 9 is an enlarged, fragmentary perspective view of the preferred elevator locking detent construction.

The recessed underside 51 of the playing board, as best viewed in FIGS. 4 and 6 comprises four spaced apart sunken orifices 70 for storing the bags 32 when the apparatus is disposed in the transportable mode. Resilient straps 72 secure the bags within orifices 70. As best seen in FIG. 8, the peripheral circular walls 74 of each sunken orifice function as reinforcement ribs to prevent bending or deflection of the boards upon bag impact. As a result, separate reinforcement ribs are unnecessary.

The preferred width to length ratio of the larger elevator tray 38 is 0.667. The preferred width to length ratio of the smaller elevator tray 37 is 0.25. In the best mode the thickness of the playing board (as measured through the peripheral wall) is 1.25. It is preferred that the width to length ratio of the playing board is 0.667. The elevator trays are blow molded from polyethylene, and they are hollow for receiving ballast (i.e. sand) to stabilize the game. It is preferred that a slope of approximately ten degrees be utilized during play. It is also preferred that eight bags are used, each weighing approximately eight ounces. Four bags are thus stored in the board underside.

RULES OF PLAY

In the best mode the game is played by either two players or two teams of players. Where teams are involved, one member of each team will be placed at either end of the playing ground. In most cases it has proven best to have the targets disposed approximately twenty feet apart. Team partners face each other from opposite targets and play can commence at either end. Each team plays with a set of four bags, and in the case of teams, opponents alternate tossing until all of the bags have been tossed. Scoring is determined according to preestablished rules, and the scoring team tosses first in the next round.

The rules prefer that the game lasts until twenty-one points have been scored. Three points are given for the penetration of the hole in the target by a bag. One point is given when a bag remains on the board after tossing. Total points awarded after a play are determined by subtracting the number of points scored by the lesser scoring team from the number of points scored by the greater. For example, if during one play team one lands one bag in the hole it receives a preliminary three points. However, if team two places two bags on the board, it achieves two points. The lesser score of two points is subtracted from the higher three point score to give a first round score for team one of one point.

Bags pushed into the hole by an opponents toss count in point generation. However, if a bag is knocked off the board by an opponent, then no score is awarded for the bag falling off. No score is awarded for a bag tossed out of turn, or for a bag which although partially on the board, is touching the ground. There is no score awarded for a bag tossed by a player who foot fouls. Foot fouling is generally defined as throwing when ones feet cross the plane established by the smaller elevator tray 37.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A portable, compact projectile tossing game for use by one or more players, said game comprising:

first and second target assemblies adapted to either be coupled to one another to dispose said game in a transportable mode or to be separated and detached from one another for orientation in an inclined configuration to dispose said game in a play mode;

a plurality of projectiles for tossing by said players at said target assemblies; and, each of said target assemblies comprising:

a resilient, generally planar playing board comprising an aperture penetrable by said projectiles, pin means projecting away from said board, and aperture means defined in each playing board for mating with and receiving the pin means emanating from the other playing board when said boards are fitted together; and elevator means foldably associated with each playing board adapted to be selectively disposed in either:

i) a storage orientation generally parallel with said playing board; or, ii) an operational orientation perpendicular to said playing board.

2. The tossing game as defined in claim 1 wherein said first and second target assemblies are structurally identical with one another.

3. The tossing game as defined in claim 2 wherein each of said playing boards comprises a plurality of regularly spaced apart, sunken orifices for storing said projectiles when said game is disposed in said transportable mode.

4. The tossing game as defined in claim 3 wherein said game comprises reinforcement rib means defined by and between said sunken orifices.

5. The tossing game as defined in claim 1 wherein each playing board is generally rectangular and comprises an external target surface, an internal surface, a pair of spaced-apart ends, and a peripheral wall bounding said internal surface, and wherein said pin means and said aperture means are spaced apart along said wall.

6. The tossing game as defined in claim 5 wherein said elevator means comprises a first elevator tray pivotally associated with a first end of said playing board, and a second elevator tray pivotally associated with another end of said playing board, said first elevator tray being larger than said second elevator tray.

7. The tossing game as defined in claim 6 wherein said internal surface comprises detent means frictionally contacted by said elevator means when said first and second elevator trays are pivoted between storage and deployed positions for yieldably locking said elevator trays in the deployed position.

8. The tossing game as defined in claim 7 wherein each of said playing boards comprises a plurality of regularly spaced apart, sunken orifices defined in said internal surface between said opposite ends of said playing board for storing said projectiles when said game is disposed in said transportable mode.

9. The tossing game as defined in claim 8 wherein said internal surface comprise reinforcement rib means defined by and between said sunken orifices.

10. The tossing game as defined in claim 8 wherein said internal surface comprises resilient strap means for retaining said projectiles within said sunken orifices.

11. The tossing game as defined in claim 1 including a recessed external surface defined in said playing board for receiving an apertured insert for displaying an advertisement.

12. The tossing game as defined in claim 11 wherein said elevator means comprises a recessed circle for registering with said aperture when said game is disposed in the transportable position for displaying the remainder of said advertisement.

13. The tossing game as defined in claim 1 including means for non-destructively reversibly flush mounting said game upon a wall.

14. The tossing game as defined in claim 13 wherein said mounting means comprises surface mounted hook means adapted to engage at least a portion of said aperture for holding said game, said game operable to conceal said hook means when so held.

15. A portable, modular tossing game for one or more players, said game comprising:

a pair of substantially identical, blow molded plastic target assemblies adapted to either be coupled to one another to dispose said tossing game in a transportable mode or to be separated and detached from one another to dispose said game in a playing mode, each of said target assemblies comprising:

a resilient, generally rectangular playing board comprising an external target surface, an internal surface, a target aperture, a pair of ends, pin means projecting away from said board, and aperture means defined in each playing board for mating with and receiving the pin means emanating from the other playing board when said boards are fitted together; and, elevator means associated with each playing board for inclining said playing board for subsequent play, said elevator means adapted to be selectively disposed in either:

i) a storage orientation generally parallel with said playing board; or, ii) an operational orientation generally perpendicular to said playing board;

a plurality of bags adapted to be tossed by players toward said target assemblies; and, rules for determining points awarded to players in accordance with the final resting position of played bags.

16. The tossing game as defined in claim 15 wherein each playing board is generally rectangular and comprises an external, recessed target surface, an internal surface, a pair of spacedapart ends, and a peripheral wall bounding said internal surface, and wherein said pin means and said aperture means are spaced apart along said wall.

17. The tossing game as defined in claim 16 wherein each of said playing boards comprises a plurality of regularly spaced apart, sunken orifices defined in said internal surface between said opposite ends of said playing board for storing said bags when said game is disposed in said transportable mode.

18. The tossing game as defined in claim 17 wherein said internal surface comprises reinforcement rib means defined by and between said sunken orifices.

19. The tossing game as defined in claim 17 wherein said elevator means comprises a first elevator tray pivotally associated with a first end of said playing board, and a second elevator tray pivotally associated with the other end of said playing board, said first elevator tray being larger than said second elevator tray.

20. The tossing game as defined in claim 19 wherein said internal comprises detent means frictionally contacted by said elevator means when said elevator trays are pivoted between storage and deployed positions for yieldably locking said elevator trays in the deployed position.

* * * * *